US005122072A

United States Patent [19]

Arn et al.

[11] Patent Number: 5,122,072

[45] Date of Patent: Jun. 16, 1992

[54] CAM-LOCK BUSWAY JOINT ASSEMBLY

[75] Inventors: Gary D. Arn, Cincinnati; Gilbert A. McGoldrick; Glenn S. O'Nan, both of Hamilton; Lisa C. Simmering, Oxford, all of Ohio

[73] Assignee: Square D Company, Palatine, Ill.

[21] Appl. No.: 630,653

[22] Filed: Dec. 20, 1990

[51] Int. Cl.[5] ..... H01R 25/00; H01R 4/50

[52] U.S. Cl. ..... 439/210; 439/213

[58] Field of Search ..... 439/210, 213, 259, 261, 439/262, 268, 269, 723, 724, 796, 797, 798; 174/88 B

[56] References Cited

U.S. PATENT DOCUMENTS

| | | | |
|---|---|---|---|
| 3,180,924 | 4/1965 | Rowe | 174/88 B |
| 3,384,854 | 5/1968 | Jorgensen et al. | 439/114 |
| 4,272,646 | 6/1981 | Carlson | 174/88 B |
| 4,504,101 | 3/1985 | Reimer | 439/261 |
| 4,505,527 | 3/1985 | Reimer | 439/261 |
| 4,820,177 | 4/1989 | Slicer | 439/114 |
| 4,983,132 | 1/1991 | Weidler | 439/724 |

*Primary Examiner*—Gary F. Paumen
*Attorney, Agent, or Firm*—Larry I. Golden

[57] ABSTRACT

A connector for electrically connecting a plurality of electrical conductors of a first busway section to a plurality of electrical conductors of a second busway section. The electrical connection is accomplished by a plurality of pairs of electrical joint connectors, each pair having an independently operable rotational clamping mechanism for clamping that pair of joint connectors tightly to corresponding electrical conductors of the first and second busway sections. An activating cap is used to manually rotate the clamping mechanism between a first and second position. In the first position the pairs of joint connectors are clamped tightly to the busway conductors. In the second position the pairs of joint connectors are loosened permitting an easy insertion or removal of the busway conductors. The pairs of joint connectors of opposite polarity are separated from each other by a phase insulator. Phase insulators also separate the electrical phases from a protective enclosure surrounding the busway. The joint connectors, rotational clamping mechanism, and phase insulator are held in place by an electrically insulated frame comprised of two halves. The frame is held together by four assembly rods which pass through the two halves of the frame. A cover plate for closing a joint access opening in the busway protective enclosure locks the rotational clamping mechanism in its first position preventing it from rotating to its second position.

11 Claims, 4 Drawing Sheets

CAM-LOCK BUSWAY JOINT ASSEMBLY

FIELD OF THE INVENTION

The present invention relates to a means for making an electrical connection between an electrical conductor of a first busway section and an electrical conductor of a second busway section and more specifically to the use of a rotating cam mechanism for applying a clamping force on the joint connectors to provide a positive electrical connection.

BACKGROUND OF THE INVENTION

Previous methods of making the electrical connection between the conductors of two adjoining busway sections have employed a bolt or bolts as disclosed in U.S. Pat. No. 3,384,854 issued May 21, 1968, U.S. Pat. No. 4,820,177 issued Apr. 11, 1989, U.S. Pat. No. 3,180,924 issued Apr. 27, 1965 or U.S. Pat. No. 4,272,646 issued Jun. 9, 1981. Other methods of connecting busway conductors have employed only springs to provide the clamping force required for electrical connection.

SUMMARY OF THE INVENTION

This invention includes a plurality of independently and cam operable joint connectors for connecting the electrical conductors of a first busway section to the electrical conductors of a second busway section. A rotating cam mechanism operated by an activating cap applies the force required for making a good electrical connection between the busway conductors and the joint connectors. A plurality of phase insulators electrically separate the joint connectors of opposite polarity from each other. A pair of electrically insulated frame halves are used to support the electrical connectors, the rotating cam mechanism, and the phase insulators. Four assembly rods, one in each corner of the frame, hold the assembly together. A cover plate placed over a joint inspection opening in the busway enclosure inhibits physical contact with live electrical conductors in the joint and also provides a means for locking the activating caps in the tightened position to prevent any loosening of the electrical connection. It also provides a visual indication that the joint connectors are in the proper position for operation.

The cam-lock joint assembly of this invention requires only a ¼ turn of the activating caps to provide the clamping force required for a tight electrical connection.

It is an object of this invention to provide an economical ready-operable joint assembly for the connection of electrical conductors of a first busway section to the electrical conductors of a second busway section.

Other features and advantages of the invention will become apparent to those skilled in the art upon review of the following detailed description, claims and drawings.

DESCRIPTION OF THE PREFERRED EMBODIMENT

Figure 1:
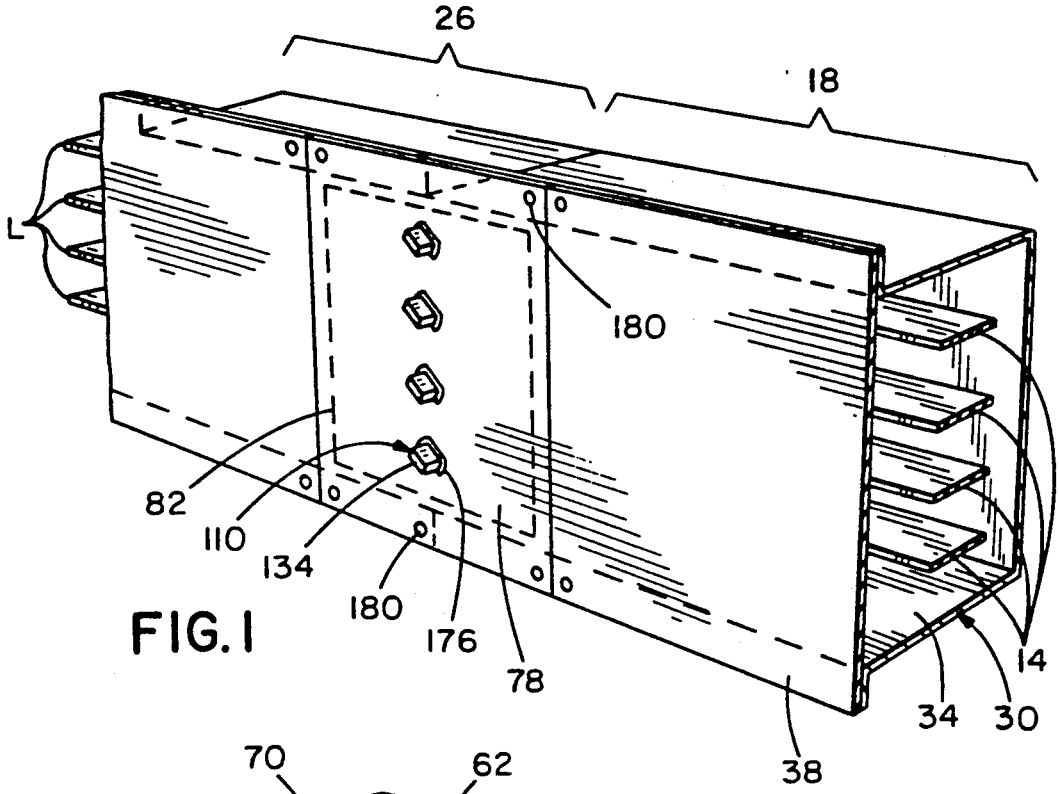
FIG. 1 is an isometic view of two adjoining busway sections including an installed cover plate which covers the joint inspection opening between the two busway sections and locks the cam mechanism in the tightened position.
Figure 2:
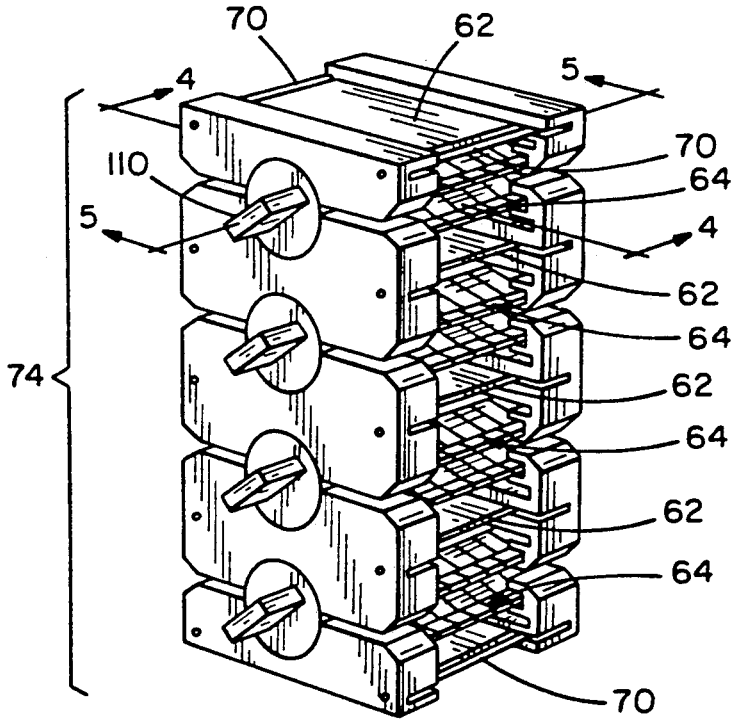
FIG. 2 is an isometric view of a cam lock joint assembly.

An assembly as illustrated in FIG. 2 is used for connecting a plurality of electrical conductors 14 of a first busway section 18 with a plurality of electrical conductors 22 of a second adjoining busway section 26 as shown in FIG. 1. A protective enclosure 30 comprised of a trough 34 and a cover 38 surrounds and protects the conductors 14 and 22 from physical damage and provides protection against electrical shock. The assembly described herein relates to a low voltage, low amperage busway system although modifications will become apparent to adapt the assembly for higher rated busway systems.

Figure 4:
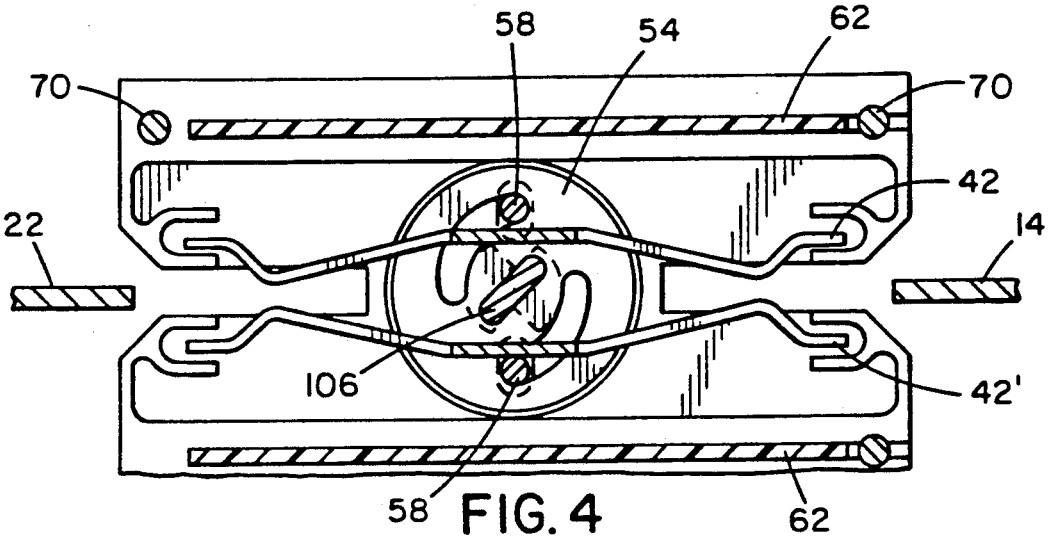
FIG. 4 is a cross-sectional view along line 4—4 of FIG. 2 of a cam lock joint assembly showing the joint assembly in the loosened position prior to installing the busway electrical conductors.
Figure 5:
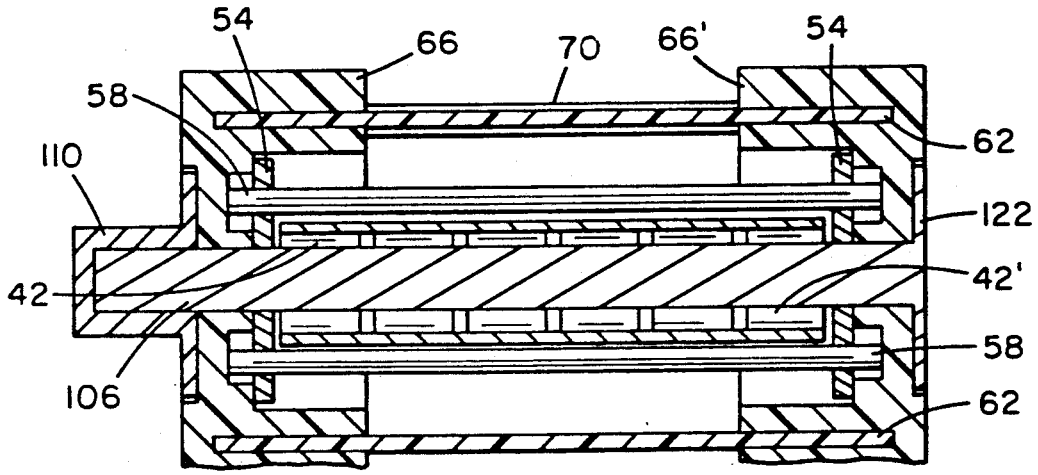
FIG. 5 is a cross-sectional view along line 5—5 of FIG. 2 of the joint assembly taken through the activating shaft.

As shown in FIG. 4, two indentical joint connectors 42 and 42' assembled in opposed relationship to each other form a pair of joint connectors 64 which are utilized to connect an electrical conductor 14 of the first busway section 18 with a corresponding electrical conductor 22 of the second busway section 26. A pair of cam plates 54 and a pair of clamping rods 58 operating together apply a clamping force on the pair of joint connectors 64 to provide a positive electrical connection with the busway conductors 14 and 22. As shown in FIG. 2, a phase insulator 62 is placed between each pair of joint connectors 64 to separate the electrical phases from each other and an insulator 62 is also placed between the outer most pairs of joint connectors 64 and the protective enclosure 30 to separate the outer electrical phases from the protective enclosure 30. The joint connectors 42 and 42', cam plates 54, clamping rods 58, and phase insulators 62 are mounted between a pair of insulated frame halves 66 and 66'. Four assembly rods 70, one in each corner of the frame halves 66 and 66', hold a joint pack assembly 74 together. The rods 70 are formed from an insulative material and are heated or otherwise deformed at opposite ends adjacent the outside of frame halves 66 and 66' to hold the joint pack assembly together.

A cover plate 78 installed over a joint inspection opening 82 in the busway enclosure cover 38 provides a means as will be hereinafter further described for locking each pair of joint connectors 64 in a first position wherein each pair of joint connectors 64 is held tightly against the respective busway conductors 14 and 22. The cover plate 78 also provides a barrier to physical contact with the current carrying parts of the busway and joint assembly.

Figure 9:
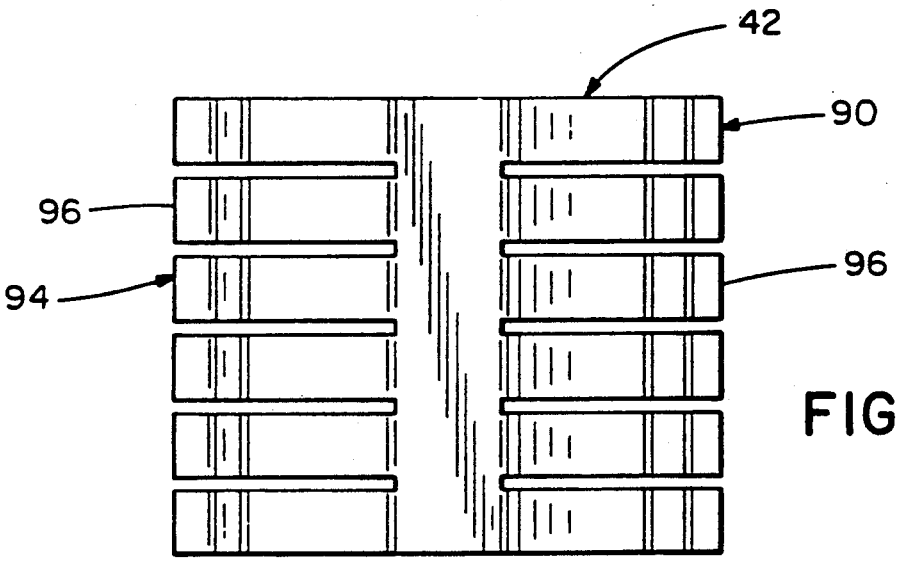
FIG. 9 is a top view of a joint connector.
Figure 10:
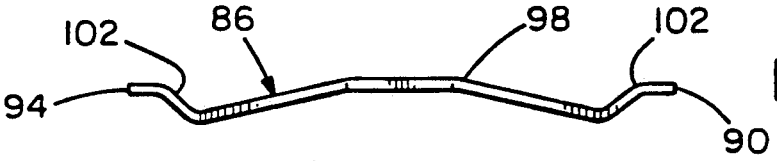
FIG. 10 is a side view of a joint connector.
Figure 11:
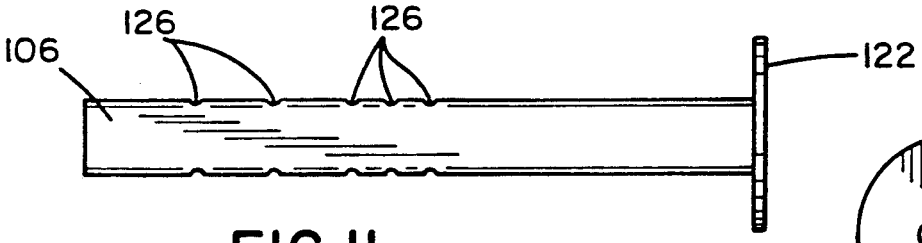
FIG. 11 is a top view of a cam activating shaft.
Figure 13:
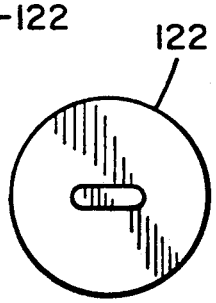
FIG. 13 is a front view of the circular plate which is permanently attached to one end of the cam activating shaft.
Figure 12:
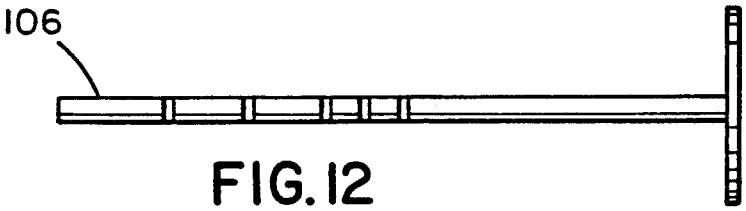
FIG. 12 is an edge view of a cam activating shaft.

As shown in FIG. 9 a rectangularly shaped joint connector 42 or 42' includes a first end 90 which contacts the electrical conductor 14 of the first busway section 18, a second end 94 which contacts the electrical conductor 22 of the second busway section 26 and a plurality of fingers 96 being parallel to one another and running perpendicular to the ends 90 and 94 of the joint connector 42. As shown in FIG. 10 each joint connector also includes an outward bow 98 running between the ends 90 and 94 and an outward offset 102 running parallel to the ends 90 and 94 of the joint connector 42 which combine to form a flattened W-shape when the joint connector 42 is viewed from the side. The offset 102 permits an easier insertion of the busway conductor 14 and 22 into the space between the pair of joint connectors 64.

Figure 3:
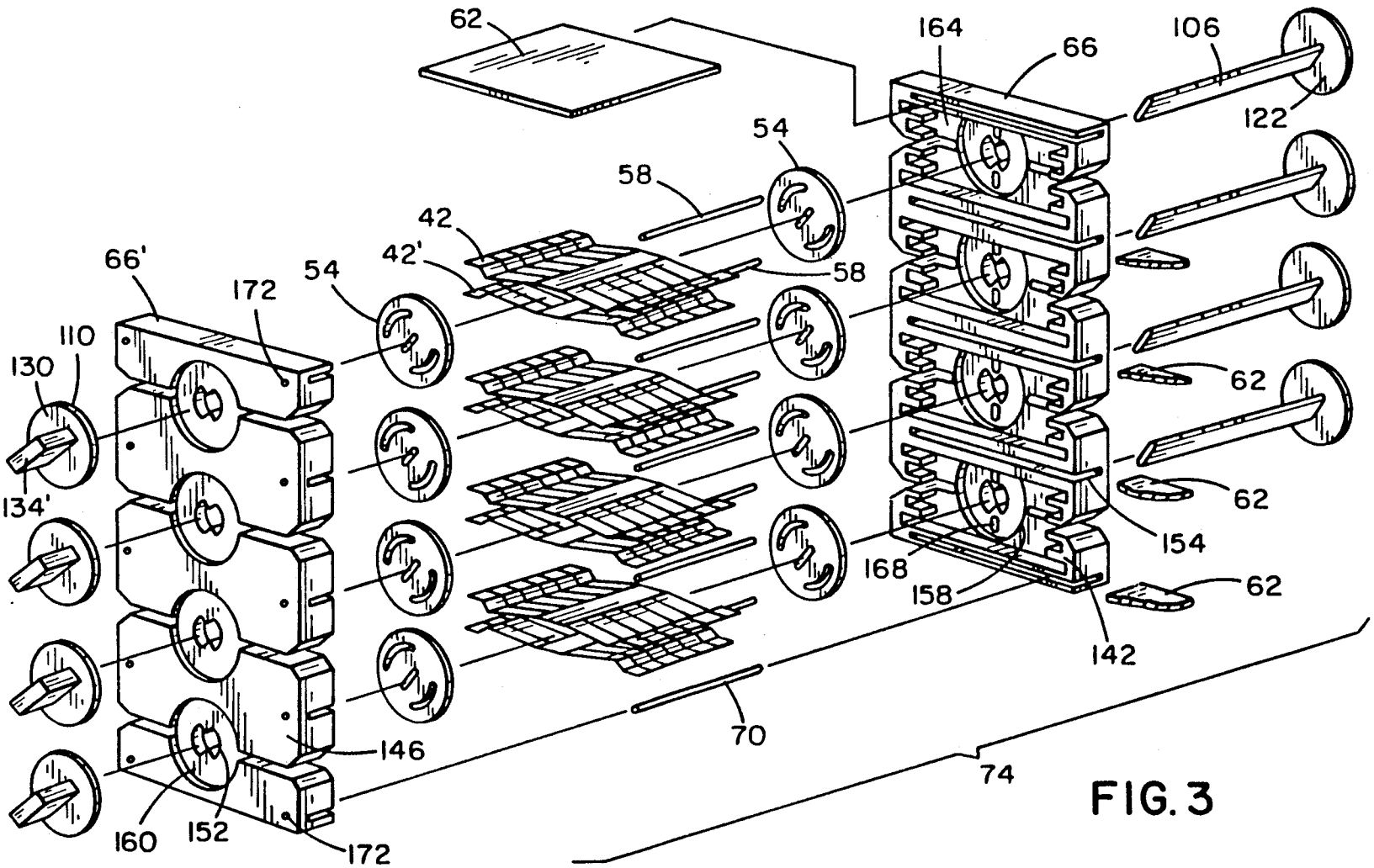
FIG. 3 is an exploded view of a cam lock joint assembly.
Figure 6:
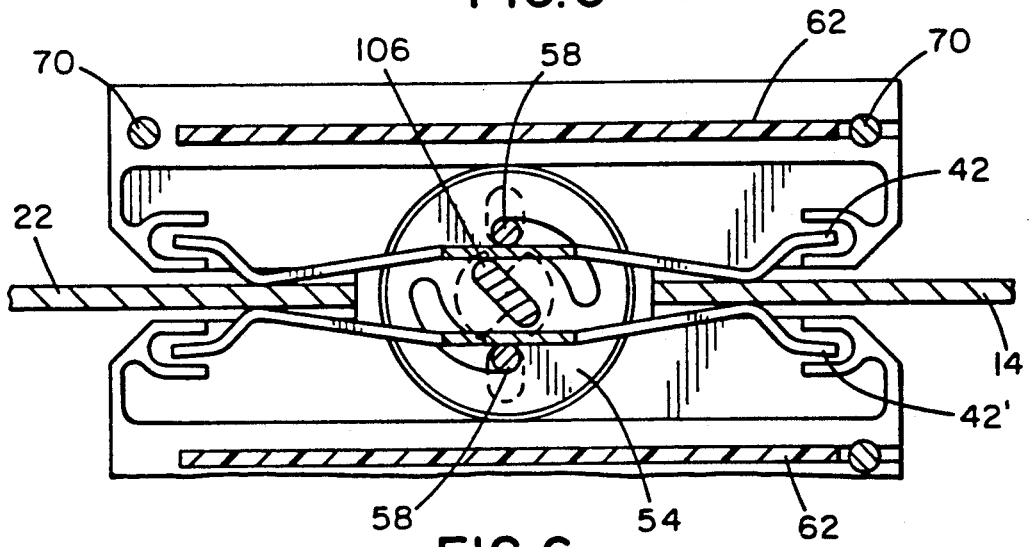
FIG. 6 is a cross-sectional view along line 4—4 of FIG. 2 of a cam lock joint assembly showing the joint in the tightened position with the busway conductors installed.
Figure 7:
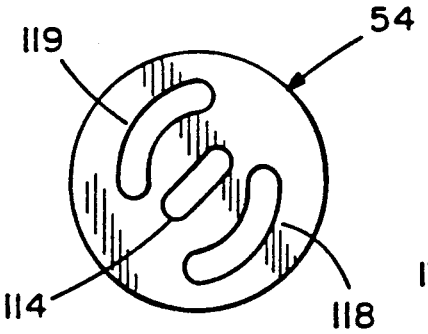
FIG. 7 is a front view of the cam plate showing the oval and spiral slots.
Figure 8:
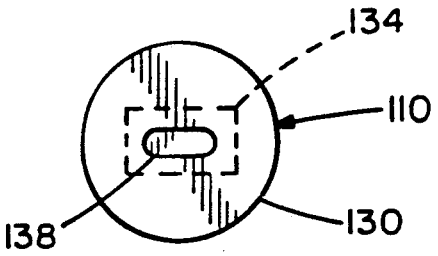
FIG. 8 is a back view of the activating cap showing the oval aperture.

The clamping means comprises a pair of circular cam plates 54 which are rotated by an activating shaft 106. An electrically insulated activating cap 110 is attached to one end of the activating shaft 106 for the purpose of manually rotating the activating shaft 106 between a first position coinciding with a "closed" or "clamped" state and a second position coinciding with an "open" or "released" state of associated connectors 64. As the cam plates 54 are rotated to the first position as shown in FIG. 6 they move a pair of clamping rods 58 which exert force on the bowed portion 98 of the opposed joint connectors 42 and 42'. This clamping force provides a good electrical connection between the joint connectors 42 and 42' and the respective electrical conductors 14 and 22 of the busway. When the cam plates 54 are rotated to the second position as shown in FIG. 4, the clamping rods 58 do not apply force to the bowed portion 98 of the joint connectors 42 and 42'. When the cam plates 54 are in this second position the conductors 14 and 22 may easily removed or inserted into the space between the joint connectors 42 and 42'. Each cam plate 54 includes an oval slot 114 for the passage of the activating shaft 106 and a pair of spiral slots 118 equally spaced about the oval slot 114 for engaging the clamping rods 58. The activating shaft 106 includes a circular plate 122 permanently fixed to one end of the shaft 106 and a plurality of small notches 126 along edge of the shaft 106. The small notches 126 mark points for cutting the shaft off depending on the width of the busway conductors it is to be used with. The electrically insulated activating cap 110 is attached to the end of the activating shaft 106 opposite the circular plate 122. The activating cap 110 is generally shaped like a top hat, a rectangular box like portion 134 extending outward from a flat circular portion 130 as shown in FIG. 3. An oval aperture 138, best seen in FIG. 8, extends from the surface of the flat circular portion 130 into the rectangular box like portion 134 to receive one end of the activating shaft 106.

The joint pack assembly 74 consists of two insulated frame halves 66 and 66' assembled in opposed relationship to each other. Each half of the frame 66 and 66' includes an inside surface 142 and an outside surface 146. A plurality of figure 8-shaped apertures 150 connecting the inside surface 142 with the outside surface 146 are equally spaced apart along the longitudinal axis of the frame half 66 and 66'. The activating shafts 106 pass through the figure 8-shaped apertures 150. A plurality of narrow slots 154 for captivating the phase insulators 62 are equally spaced apart and parallel to one another on the inside surface 142 of the frame halves 66 and 66'. The slots 154 run perpendicular to the longitudinal axis of the frame halves 66 and 66'. A pluality of circular recesses 158 on the inside surface 142 are concentric with the figure 8-shaped apertures 150 and receive the cam plates 54. A plurality of circular recesses 160 on the outside surface 146 are also concentric with the figure 8-shaped apertures 150. These circular recesses 160 receive either the circular plates 122 which are permanently attached to one end of the activating shaft 106 or the activating caps 110 which are attached to the opposite end of the activating shaft 106. A plurality of recessed areas 164 on the inside surface 142 receive the joint connectors 42 and 42'. A plurality of oval slots 168 located in the circular recesses 158 receive the clamping rods 58. A round aperture 172, in each of the four corners of the frame half 66 and 66' receives the assembly rods 70 which hold the joint pack assembly 74 together as previously described.

The cover plate 78 includes a plurality of substantially parallel rectangular slots 176 for locking for activating caps 110 in the first position. The slots 176 are evenly spaced apart along the vertical axis of the cover plate 78 and placed at an angle which coincides with the activating cap 110 in its first position. The slots 176 will permit the rectangular portion 134 of the activating caps 110 to pass through only when the activating caps 110 are in the first position wherein the joint connection is tight. The cover plate 78 is attached to the busway enclosure cover 38 by a plurality of screws 180 or other fastening means. When the cover plate 78 is secured to the busway enclosure cover 38, and the rectangular portions 134 of the activating caps 110 are protruding through the slots 176, the activating caps 110 are prohibited from rotating from their first position to their second position.

It is to be understood that the invention is not limited in its application to the details of construction and description set forth above or illustrated in the drawings. The invention is capable of other embodiments and of being practiced or carried out in various other ways. Also, it is to be understood that the phraseology and terminology used herein is for the purpose of description and should not be regarded as limiting.

What we claim is:

1. A connector for electrically connecting a plurality of electrical conductors of a first section respectively to one of a plurality of electrical conductors of a second busway section comprising:

a plurality of pairs of joint connectors for electrically connecting the conductors of the first busway section respectively to one of the electrical conductors of the second busway section;

a plurality of clamping means, each clamping means for independently clamping a respective pair of said joint connectors to a tightened position in pressure engagement with the respective electrical conductors of the first and second busway sections thereby providing a positive electrical connection between the conductors of said first busway section and the conductors of said second busway section;

a plurality of phase insulators for electrically separating said pairs of joint connectors from each other;

a frame comprised of two halves being spaced apart and in opposed relationship to each other, said frame carrying said joint connectors, said clamping means, and said phase insulators;

a plurality of assembly rods connecting said frame halves together, and locking means for locking said clamping means in the tightened position to prevent loosening of the electrical connection between the conductors of the first and second busway sections, said locking means also providing a visual indication as to whether said clamping means is in the tightened position.

2. A connector as claimed in claim 1 wherein said joint connectors are generally retangular and have a flattened W-shaped cross-section, said joint connectors are assembled in pairs in opposed relationship to each other, each pair connecting one electrical phase of the busway conductors and, each said joint connector further comprising:

a first end for connecting to the conductors of the first busway section;

a second end for connecting to the conductors of the second busway section;

a plurality of fingers each being parallel to one another and being perpendicular to and running inward from each said first and second ends, each said finger having an offset for permitting easier entrance of the busway conductor between opposed pairs of said joint connectors.

3. A connector for electrically connecting a plurality of electrical conductors of a first busway section respectively to one of a plurality of electrical conductors of a second busway section comprising:

a plurality of pairs of joint connectors for electrically connecting the conductors of the first busway section respectively to one of the electrical conductors of the second busway section;

clamping means for clamping said joint connectors to a tightened position in pressure engagement with the electrical conductors of the first and second busway sections thereby providing a positive electrical connection between the conductors of said first busway section and the conductors of said second busway section;

a plurality of phase insulators for electrically separating said pairs of joint connectors from each other;

a frame comprised of two halves being spaced apart and in opposed relationship to each other, said frame carrying said joint connectors, said clamping means, and said phase insulators;

a plurality of assembly rods connecting said frame halves together; and locking means for locking said clamping means in the tightened position to prevent loosening of the electrical connection between the conductors of the first and second busway sections; and said clamping further comprising:

a plurality of flat activating shafts for mechanically operating said clamping means;

a plurality of metallic clamping rods which apply a force to said joint connectors;

a plurality of circular cam plates which are slidably mounted on said activating shafts and move said clamping rods when said activating shafts are rotated; and a plurality of activating caps for rotating said activating shafts.

4. A connector as claimed in claim 3 wherein each said cam plate includes an oval slot in the center thereof for slidably placing said cam plate on said flat activating shaft and a pair of spiraling slots being equally spaced apart about the longitudinal axis of said oval slot for engaging said clamping rods.

5. A connector as claimed in claim 3 wherein each said activating cap is made of an insulating material and generally top hat-shaped such that a generally rectangular box like portion extends outward from a flat circular portion and includes therein an oval aperture on said flat circular portion which extends into said rectangular box like portion for slidably receiving one end of said activating shaft.

6. A connector as claimed in claim 3 wherein each said flat activating shaft comprises:

a circular disk permanently fixed to one end of said activating shaft; and a plurality of notches along said activating shaft for marking cut-off points determined by the width of the busway conductors.

7. A connector as claimed in claim 3 wherein each said mounting frame half is made of an electrically insulating material and includes an inside surface; an outside; a plurality of figure 8-shaped apertures passing from said inside surface to said surface and being equally spaced apart and placed such that the minor axis of said figure 8-shaped aperture coincides with the longitudinal axis of said frame half, said apertures receive said activating shafts; a plurality of circular recesses on said inside surface being concentric about said figure 8-shaped apertures, for receiving said cam plates; a pair of oval slots being inside each said circular recess on said inside surface and placed such that the longitudinal axis of said slots coincides with the longitudinal axis of said frame half, for receiving said clamping rods; a plurality of narrow slots on said inside surface being perpendicular to the longitudinal axis of said frame half for captivating said phase insulators; a plurality of recessed areas on said inside surface of said frame for receiving said joint connectors, said recesses being symmetrical about the longitudinal axis of said frame; a plurality of circular recesses on said outside surface being concentric about said figure 8-shaped apertures, for receiving said circular plates fixed to said activating shafts and said activating caps; and a plurality of round apertures, one in each corner of said frame half, for receiving said assembly rods which hold said insulated frame halves together.

8. A connector as claimed in claim 3 wherein the first and second busway sections each include a protective enclosure with an access opening on one side at the joint area for installing and viewing said joint connecting assembly and wherein said locking means comprises:

a cover plate, generally rectangular in shape and including a plurality of rectangular apertures for accepting said rectangular box like portions of said activating caps, said apertures being evenly spaced apart along the longitudinal axis of said cover plate and at an angle such that said rectangular box like portions of said activating caps can only pass through said apertures when said caps are rotated to the clamped joint position, and;

means for attaching said cover plate to the busway protective enclosures of the first and second busway sections such that the access opening is closed.

9. A connector for respectively connecting a plurality of conductors of a first busway section to a respective one of a plurality of conductors of a second busway section comprising:

a pair of opposite frame members;

a plurality of pairs of joint connectors intermediate said frame members, each pair of said joint connectors associated with a respective one of said conductors of said first busway section and a respective one of said conductors of said second busway section and movable between a first position wherein said associated conductors are clamped between said joint connectors to provide good electrical connection therethrough and a second position wherein said conductors are released from said associated conductors to permit removal of said conductors from between said connectors; and clamping means which can be rotated for independently moving each said pairs of joint connectors alternately between said first position and said second position.

10. A connector as claimed in claim 9 wherein said rotational clamping means includes a pair of cam plates associated with each pair of said joint connectors, each pair of cam plates positioned on opposite sides of its associated joint connector intermediate said joint connector and a respective frame member, each cam plate including a pair of spiral slots, each frame member having portions defining oval slots;

a pair of clamping rods associated with each pair of cam plates, said clamping rods extending between said cam plates and received within one of said respective spiral slots in each cam plate, said clamping rods each having its opposite ends received within one of said oval slots, said joint connectors positioned intermediate said clamping rods; and activating means for independently rotating each pair of said cam plates and causing said clamping rods to move within said spiral slots and said oval slots between a first position wherein said connectors are clamped to said associated conductors and a second position wherein said connector are released from said associated conductors.

11. A connector for connecting a first conductor to a second conductor comprising:

a pair of opposite frame members, said frame members each having a recessed area forming a pair of support channels within said recessed area;

a pair of joint connectors including an upper joint plate and a lower joint plate positioned to receive said first conductor and said second conductor therebetween, said joint plates respectively supported intermediate said frame members by said support channels; an activating cap carried by one of said frame members and rotatably movable between a first position and a second position; clamping means for biasing said upper joint plate and said lower joint plate toward each other for providing good electrical connection between said conductors in response to movement of said activating cap to said first position and for releasing said bias from said upper joint plate and said lower joint plate to release said conductors from said good electrical contact to permit removal of said conductors from said joint plates in response to movement of said activating cap to said second position, said clamping means including a pair of circular cam plates, an activating shaft connected to said activating cap and extending through a central opening in each of said cam plates, and a pair of clamping rods each extending through a respective pair of peripheral openings in said cam plates, said pair of joint connectors positioned intermediate said pair of clamping rods.

* * * * *